US005360246A

United States Patent [19]

Leiter et al.

[11] Patent Number: 5,360,246

[45] Date of Patent: Nov. 1, 1994

[54] LATCH PLATE FOR STORAGE LOCKERS

[75] Inventors: Earl Leiter; Thomas A. Joseph, both of Louisville, Ohio

[73] Assignee: Republic Storage Systems Company, Inc., Canton, Ohio

[21] Appl. No.: 50,855

[22] Filed: Apr. 21, 1993

[51] Int. Cl.[5] ..... E05C 19/00

[52] U.S. Cl. ..... 292/302; 292/DIG. 68; 292/76; 292/340

[58] Field of Search ..... 292/302, 340, 346, 300, 292/76, 70, 340, DIG. 68, DIG. 31; 70/79, 78, 80, 81, 82

[56] References Cited

U.S. PATENT DOCUMENTS

| | | | |
|---|---|---|---|
| 982,226 | 1/1911 | Good . | |
| 1,817,785 | 8/1931 | Vance | 292/DIG. 68 |
| 2,033,806 | 3/1936 | Baker et al. | 292/33 |
| 2,642,300 | 6/1953 | Pelcin | 292/173 |
| 2,835,523 | 5/1958 | Chervenka | 292/DIG. 68 |
| 2,875,604 | 3/1959 | Fohn | 292/DIG. 68 |
| 2,912,271 | 11/1959 | Schaefer | 292/DIG. 68 |
| 3,261,628 | 7/1966 | Kesling | 292/340 |
| 3,374,020 | 3/1968 | Berg | 292/175 |
| 3,521,919 | 7/1970 | Berg . | |
| 3,637,246 | 1/1972 | Leiter | 292/87 |
| 3,674,081 | 7/1972 | List | 160/161 |
| 3,744,831 | 7/1973 | Joseph et al. | 292/81 |
| 3,866,961 | 2/1975 | List | 292/336.3 |
| 3,935,935 | 2/1976 | Berg | 194/78 |
| 4,096,718 | 6/1978 | Michelman et al. | 70/63 |
| 4,530,531 | 7/1985 | Mantini | 292/302 |
| 4,573,722 | 3/1986 | Lyng | 292/148 |
| 4,580,818 | 4/1986 | Lyng | 292/148 |

OTHER PUBLICATIONS

Two photographs of "List Industries Inc." Locker (Exhibit A).

Two photographs of "DeBourgh Manufacturing Company" Locker (Exhibit B).

*Primary Examiner*—Rodney M. Lindsey

*Attorney, Agent, or Firm*—Watts, Hoffmann Fisher & Heinke

[57] ABSTRACT

A storage locker is shown having a frame supporting a hinged door. A latch plate is fixed to the inner frame for latching the door and enabling it to be locked. The latch plate includes a security finger which is notched, and which engages a rim of the door when the door is closed. The security finger serves to hold the door closed during conventional methods of unauthorized entry. The latch plate also includes a pair of stiffening legs which make it more difficult to bend, thus, making unauthorized entry more difficult. The latch plate also includes a portion for supporting a padlock tab. The portion supporting the padlock tab is yieldable such that force applied to the padlock tab will bend the support portion without allowing the more critical latch plate to bend.

20 Claims, 4 Drawing Sheets

LATCH PLATE FOR STORAGE LOCKERS

BACKGROUND OF THE INVENTION

1. Field of the Invention

The invention relates to door-latching devices, and more particularly, to a latch plate for a storage locker.

2. Description of Related Art

Storage lockers often have multiple latch points for securing the distal edge of a pivotally mounted door to the frame. Typically, a lockable lift bar operates to unlatch the door. Multiple latch point lockers provide a high degree of security since each latch point must be disengaged to gain unauthorized entry. Single-point, latch-type lockers have become popular recently because they are quieter and, since they have fewer moving parts, require less maintenance.

Single-point, latch-type lockers usually permit the door to be locked at only one point by either a padlock or a flush-mounted, key-operated, springbolt or deadbolt lock mechanism permanently attached to the locker door. Typically, single-point, latch-type lockers have a latch plate fixed to the locker side frame which has a padlock attachment tab and a plate for engaging the bolt of a springbolt lock.

A disadvantage of conventional single-point, latch-type lockers is that they are more vulnerable to unauthorized entry if they rely on a springbolt-type lock as the only latch point. One method used to break in is to twist the locker frame with a prying tool in an attempt to rotate the latch plate and separate it from the bolt of the lock. Once the bolt is separated, the door is free to open since the bolt provides the only latch point. Another method used to gain unauthorized entry is to insert a wire through the slot in the door for the padlock tab. The wire may be manipulated to retract the bolt and release the door. In another break-in method, force is applied to the exposed, unused padlock tab in an attempt to twist or bend the latch plate and thus separate it from the bolt. Thus, there is a need for a single-point, latch-type locker which resists unauthorized entry.

SUMMARY OF THE INVENTION

In its broad aspects, the storage locker includes a frame having a longitudinal hinge side frame member and a longitudinal latch side frame member spaced from and parallel to the hinge side frame member. The latch side frame member and the hinge side frame member are connected at their ends by a pair of lateral frame members. Also included is a door having a hinged side pivotally connecting the door to the hinge side frame member. A latch side is opposite the hinged side. A latch plate is fixed to the latch side frame member inside the locker at a location adjacent to the latch side when the door is closed. The latch plate is adapted to engage a lock device for locking the door to the latch plate when the door is closed. The latch plate includes a security finger projecting towards the door and engaging the door when the door is closed. The security finger has a notch formed therein for engaging a cooperating rim of the door to provide resistance to the door's pivotal movement. The notch is formed on the side of the finger facing the latch side frame member.

In preferred constructions, the latch plate includes a base plate fixed to the latch side frame member and the security finger is an extension of the base plate joined to the base plate with a horizontally extending right-angle bend.

In preferred constructions, the security finger has a vertically extending thickness dimension and a substantially greater horizontally extending width dimension.

In the preferred and illustrated embodiment, the latch device includes a base plate having a pair of stiffening legs formed as extensions of the base plate formed at right angles to the base plate such that the base plate is vertically planar and the stiffening legs are horizontally planar.

In preferred constructions, a padlock tab support portion is joined to the base plate by a relatively yieldable section of material such that a force applied in the normal direction to the support portion will cause the support portion to bend with respect to the base plate along the yieldable section before the base plate bends.

DESCRIPTION OF THE PREFERRED EMBODIMENT

Figure 1:
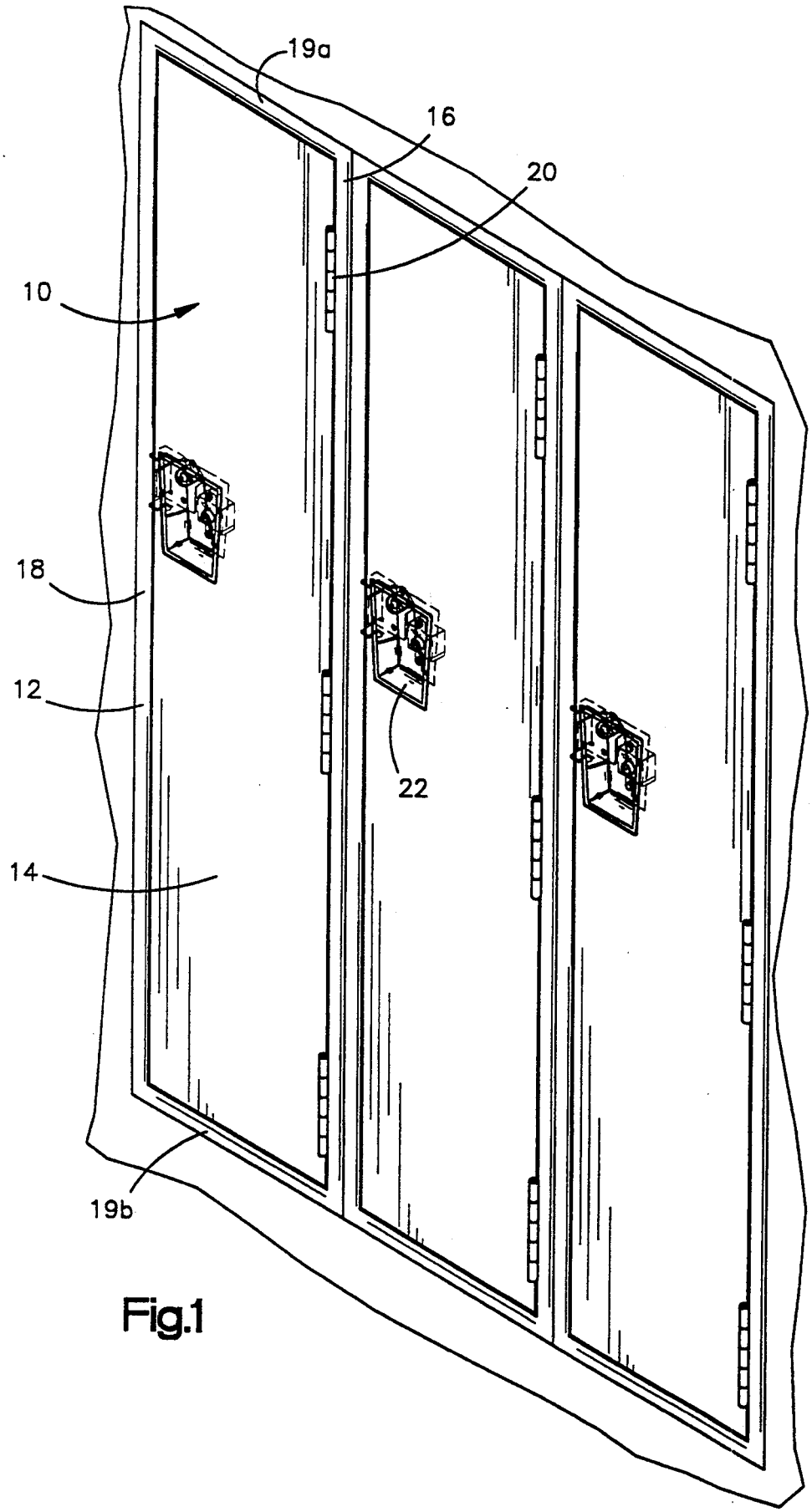
FIG. 1 is a fragmentary perspective view of three storage lockers of the present invention.

Referring to FIG. 1, a group of storage lockers 10 is shown, each having a frame assembly 12 and a door 14. Each frame assembly 12 includes a hinge side frame member 16 and a latch side frame member 18. The latch side frame member 18 is parallel to and spaced from the hinge side frame member 16. The latch side frame member and hinge side frame member are connected by upper and lower horizontal or lateral frame members **19*a*, 19*b*, respectively. Each double pan door 14 is pivotally mounted by two or more hinges 20 to the hinge side frame member 16**.

Figure 2:
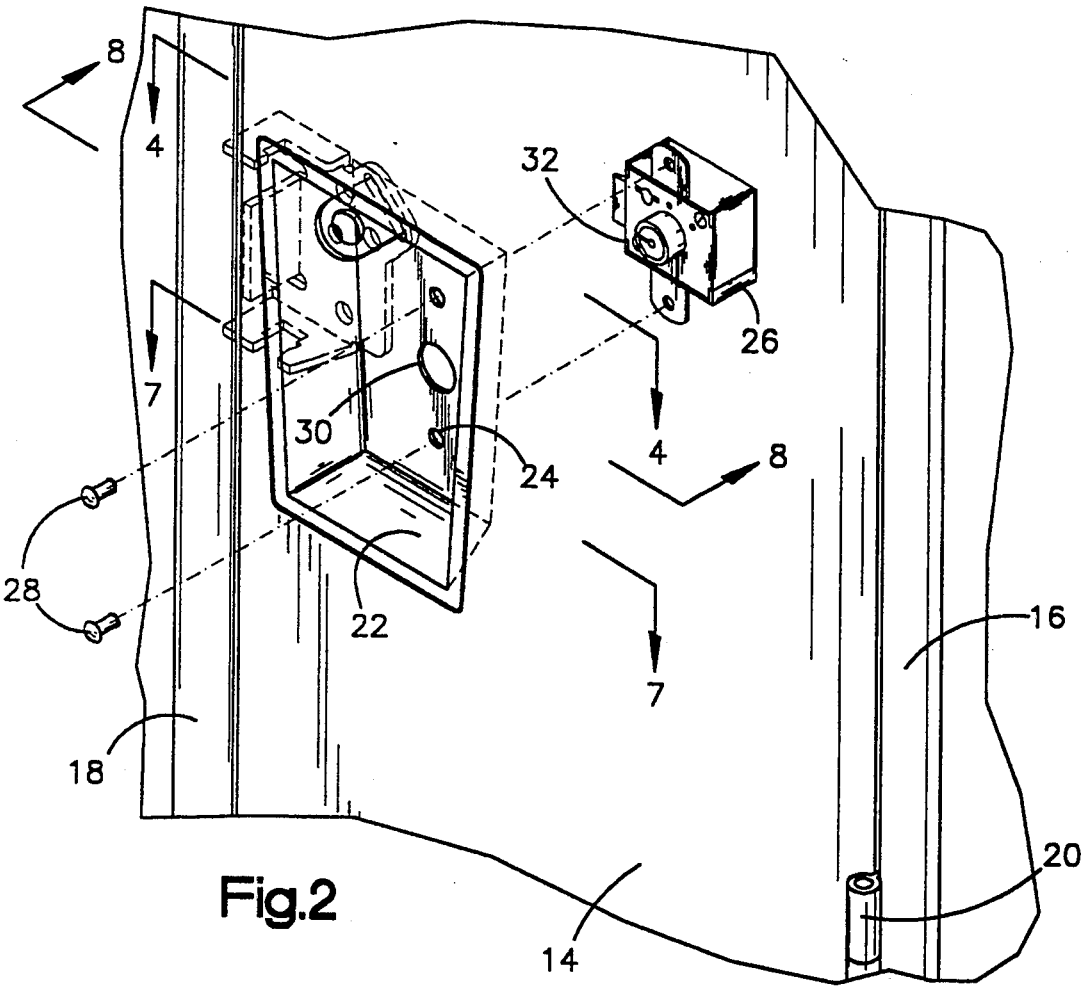
FIG. 2 is a fragmentary perspective view of a storage locker showing a latch plate in phantom.
Figure 4:
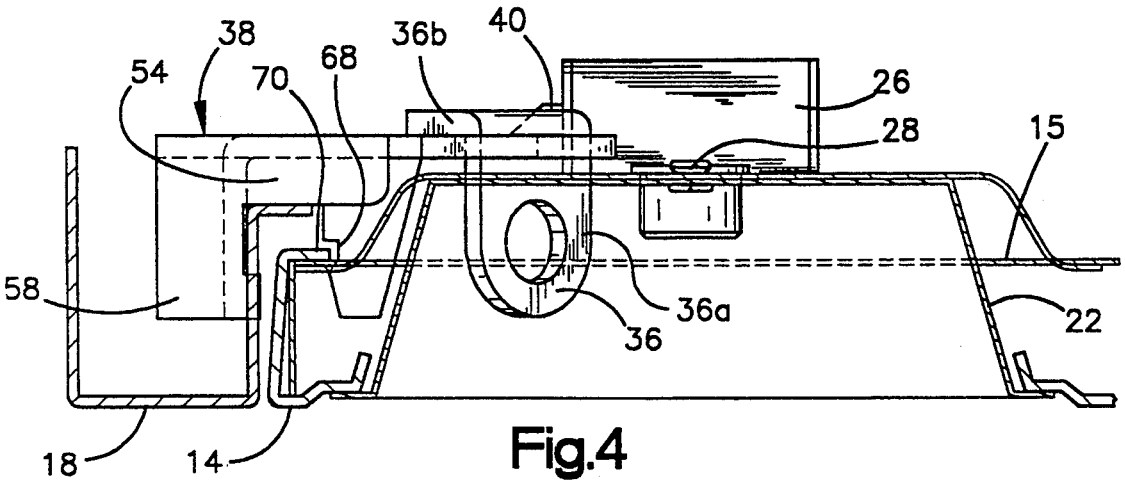
FIG. 4 is a cross-sectional view as seen approximately in the direction of the plane indicated by the line 4—4 in FIG. 2.
Figure 8:
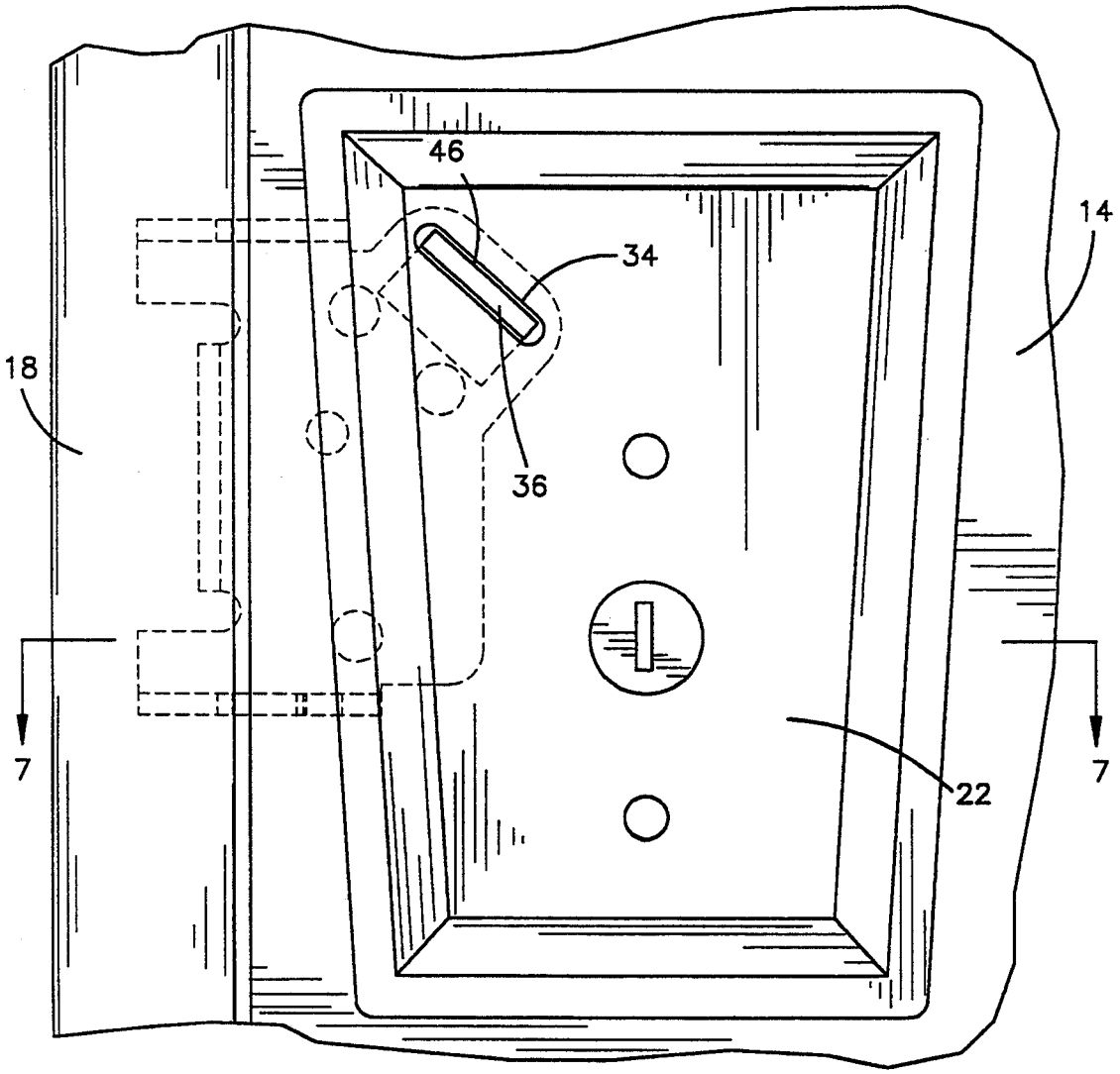
FIG. 8 is a front elevational view as seen approximately in the direction of the plane indicated by the line 8—8 in FIG. 2.

As seen in FIG. 2, a handle recess pan 22 is fitted to each door 14. The pan 22 has a pair of lock mounting holes 24 for optionally mounting a springbolt or deadbolt lock 26. Additionally, as seen in FIG. 4, an inner door reinforcing panel 15 is welded along the full height of the door 14 to provide strength and rigidity to each door 14 for single point latching to prevent an intruder from bending the door 14 to gain access to the interior of one of the lockers 10. Fasteners 28 such as bolts and nuts, rivets, etc., secure the lock to the door. A key opening 30 provides access to a key slot 32 in the springbolt lock 26. An oblong opening 34, as shown in FIG. 8, is also formed in the pan 22 for receiving a padlock tab 36 when the door 14 is closed. Thus, there are two options for locking the door 14. Either a padlock (not shown) may be locked onto the padlock tab 36 or the springbolt or deadbolt lock 26 may be employed.

As seen in FIG. 4, a latch plate 38 cooperates with either type of lock to hold the door 14 to the latch side frame member 18. If a padlock is used, the door 14 cannot be separated from the padlock tab which is connected to the latch plate 38 when the lock is in place. If a springbolt or deadbolt lock 26 is used, a retractable bolt 40 (note: a springbolt is shown) engages a catch surface 42 of the latch plate 38 to prevent the door 14 from opening.

Figure 5:
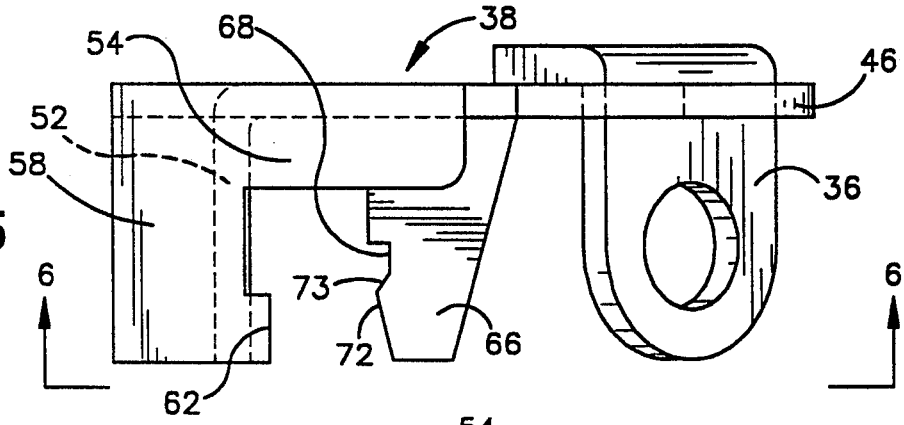
FIG. 5 is a top plan view of the latch plate shown in FIG. 3.
Figure 6:
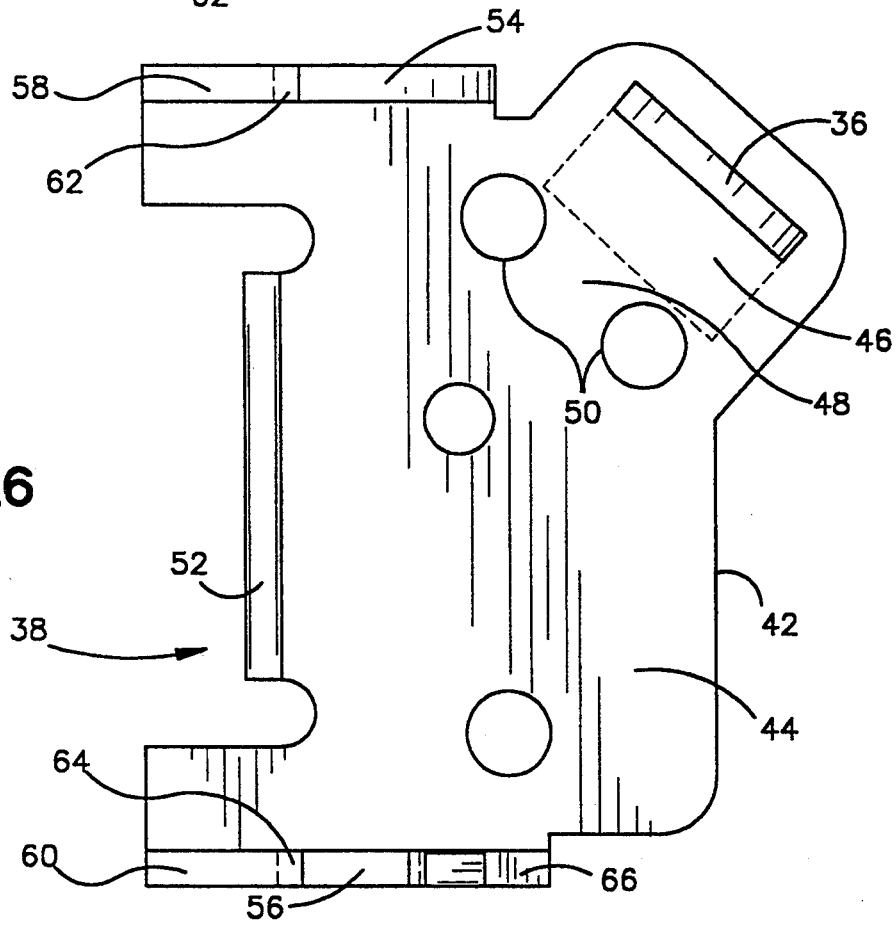
FIG. 6 is a front elevational view as seen approximately from the plane indicated by the line 6—6 in FIG. 5.

As seen in FIGS. 5 and 6, the latch plate 38 includes a planar base plate 44 having a co-planar padlock tab support portion 46. The padlock tab support portion 46 has a slot sized only slightly larger than the cross-sectional dimensions of the padlock tab 36. The tab 36 is L-shaped such that one leg 36*a* passes through the slot and is provided with a hole for receiving a padlock. The other leg 36*b* serves to provide a weld tab which is welded to the back of the latch plate 38.

The padlock tab support portion 46 is connected to the base plate 44 with a yieldable section of material 48. In the preferred and illustrated latch plate 38, the yieldable section 48 is made weaker than the surrounding material by providing two weakening holes 50. The purpose of the yieldable section 48 is to permit the padlock tab support portion 46 to bend along the yieldable section 48. Thus, the yieldable section 48 causes the padlock tab support 46 to bend with respect to the base 44, thus preventing twisting or bending of the base plate 44 when force is applied to the tab 36. The latch plate 38 further includes a planar securement tab 52 as seen in FIGS. 5 and 6. The tab 52 is at a right angle to the base plate 44. The tab 52 is welded to the inside of the latch side frame member 18 to help secure the latch plate to the frame assembly 12.

Another important feature of the latch plate 38 is the size relationship between the padlock tab support 46 and the oblong opening 34 shown in FIG. 8. When the door 14 is closed, the padlock tab support completely covers the oblong opening from the back of the door 14. With the oblong opening 34 blocked, a wire cannot be inserted for the purpose of retracting the bolt 40 of a springbolt lock.

The latch plate 38 further includes upper and lower planar stiffening legs 54, 56, respectively (FIGS. 5 and 6), which intersect the base plate 44 at right angles. The stiffening legs 54, 56 stiffen the base plate 44 to resist bending. Note that the yieldable section 48 is not stiffened by the stiffening legs 54, 56. This further encourages bending along the yieldable section 48 when a force is applied to the padlock tab 36.

Figure 3:
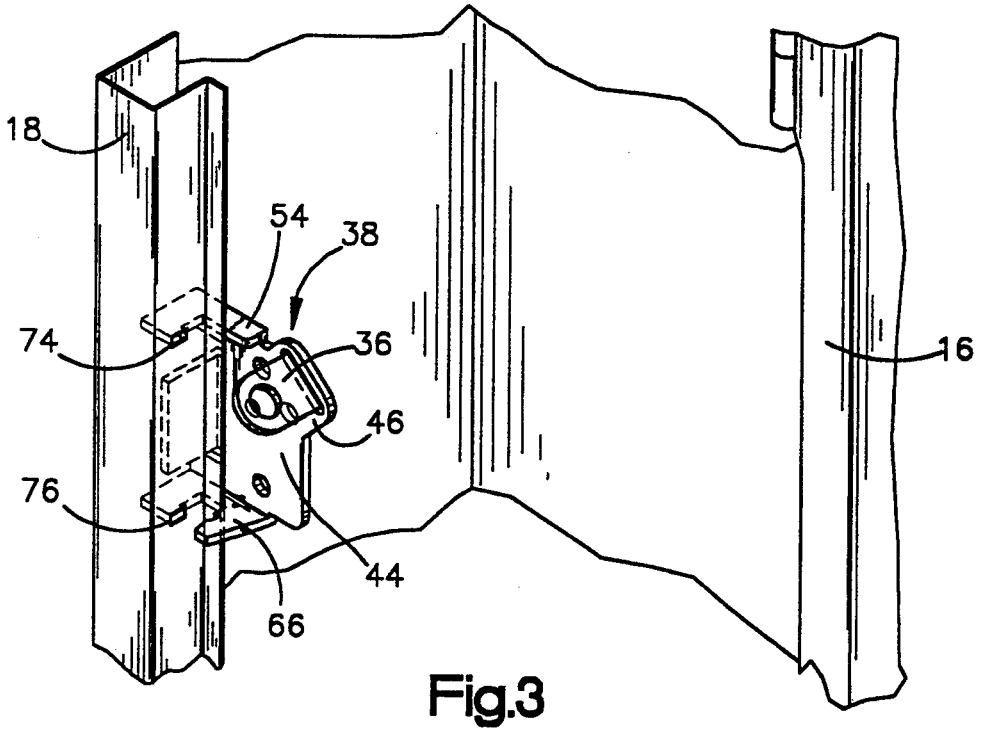
FIG. 3 is a fragmentary perspective view similar to FIG. 2 but with the door removed.

Extending in a co-planar direction from the stiffening lags 54, 56 are upper and lower frame hooks 58, 60, respectively. Each frame hook 58, 60 is L-shaped as viewed in FIG. 5. Upper and lower positioning tabs 62, 64, respectively, are provided to engage cooperating locating holes 74, 76 (see FIG. 3) formed in the latch side frame member 18. The tabs 62, 64 thus serve to properly locate the latch plate 38 during assembly and to resist movement of the latch plate 38 once it is welded in place.

Figure 7:
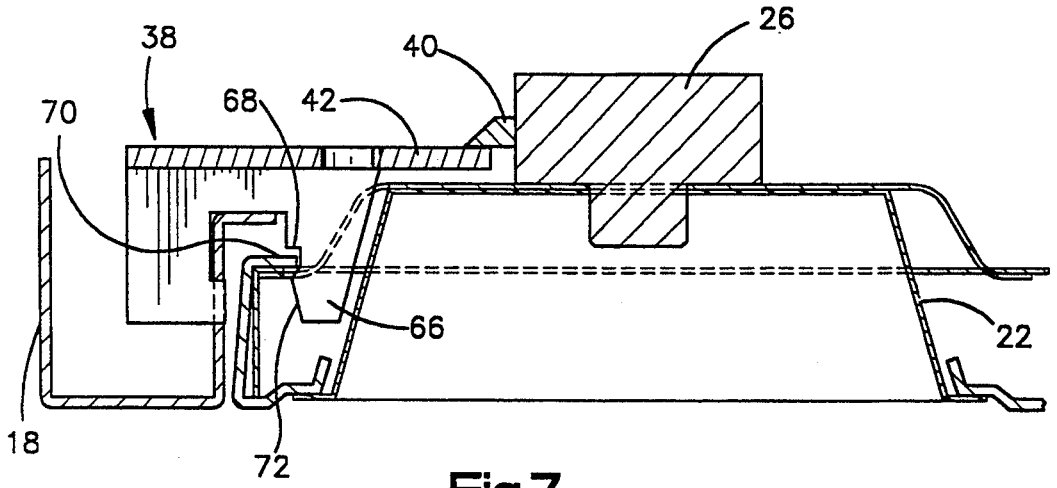
FIG. 7 is a cross-sectional view as seen approximately in the direction of the plane indicated by the line 7—7 in FIG. 2.

Extending from the lower stiffening leg 56 is a planar security finger 66. The finger 66 has a vertical thickness dimension which is much smaller than its horizontally extending width dimension. The plane of the finger 66 is thus normal to the vertical pivot axis of the hinges 20. The security finger 66 includes a notch 68 which is in the same plane but spaced from the lower frame hook 60. As best seen in FIG. 7, the notch 68 engages a rim 70 of the door when the door is closed. The rim 70 passes over a ramped surface 72 of the security finger 66 when the door is closed. The rim 70 settles in the notch 68 when the door is fully closed. The ramped surfaces 72 leading in and 73 leading out of the notch 68 provides a light resistance to door movement when the door is swung closed and pulled open.

The security finger 66 additionally serves to frustrate unauthorized entry to the lockers 10. A frequent method of unauthorized entry is to insert a prying tool between the door 14 and the latch side frame member 18 in an effort to separate the catch surface 42 from the bolt 40 by twisting the latch side frame member 18 in a clockwise or counterclockwise clockwise direction from its position as shown in FIG. 7. The security finger 66 resists separation of the door 14 from the latch side frame member 18, and thus it makes it difficult to separate the bolt 40 from the catch surface 42. To pry the door 14 away from the latch side frame 18 forces the rim 70 further into the notch 68. Thus, even if the bolt 40 should separate from the catch surface 42, the door cannot open because, due to the action of the prying tool, the notch will remain firmly engaged with the rim 70. The rim 70 tends to remain firmly engaged with the notch 68 even when such prying action twists the frame, causing the latch plate to rotate about a vertical axis.

The orientation of the security finger 66 is important for resisting bending. As with any planar member having a width dimension greater than its thickness, the security finger 66 is able to resist bending when force is applied to its edge better than when force is applied to its face. This is because the greatest amount of material opposes the force when it is applied edgewise. Thus, the security finger 66 is able to resist tremendous forces when they are applied horizontally to the edge in which the notch 68 is formed. A prying tool placed between the door 14 and the latch side frame 18 would apply such edgewise forces and would not typically deform the security finger 66.

While a preferred embodiment of this invention has been described in detail, it will be apparent that certain modifications or alterations can be made without departing from the spirit and scope of the invention as set forth in the appended claims.

We claim:

1. A storage locker comprising:

a frame assembly having a longitudinal hinge side frame member and a longitudinal latch side frame member spaced from and parallel to said hinge side frame member, wherein said latch side frame member and said hinge side frame member are connected at their ends by a pair of lateral frame members;

a door having a hinged side pivotally connecting said door to said hinge side frame member and a latch side opposite and parallel to said hinged side;

a latch plate fixed to said latch side frame member inside said locker at a location adjacent to said latch side when said door is closed, wherein said latch plate is adapted to engage a lock device for locking said door to said latch plate when said door is closed to prevent unauthorized entry to said locker; and a security finger projecting from said latch plate towards said door and engaging said door when said door is closed, said security finger having a notch formed on a side of said finger facing said latch side frame member wherein a cooperating rim of said door is adapted to engage said finger where it is notched to provide resistance to pivotal movement of said door.

2. A storage locker according to claim 1 wherein said latch plate includes a base plate fixed to said latch side frame member and said security finger is an extension of said base plate joined to said base plate with a horizontally extending right-angle bend.

3. A storage locker according to claim 1 wherein said security finger has a vertically extending thickness dimension and a horizontally extending width dimension and wherein said width dimension is substantially greater than said thickness dimension.

4. A storage locker according to claim 1 wherein said latch plate includes a base plate having a pair of stiffening legs formed as extensions of said base plate formed at right angles to said base plate such that said base plate is vertically planar and said stiffening legs are horizontally planar.

5. A storage locker comprising:

a frame structure having a hinge side frame member and a latch side frame member parallel to and spaced from said hinge side frame member;

a door pivotally mounted on said hinge side frame member, said door having a padlock slot therein;

a latch plate device connected to said latch side frame member for engaging said door when said door is closed, said latch plate device including:

a base plate;

a padlock tab support portion connected to said base plate and having an opening formed therein, said padlock tab support portion having a surface which is substantially parallel to the plane of the door when the door is closed;

a padlock tab fixed to said padlock tab support portion extending through said opening and towards said door, said tab having a hole formed therein which is adapted to receive a padlock, said tab being adapted to extend through said padlock slot; and wherein said padlock tab support portion surface extends across an area substantially larger than the area of said padlock slot such that said padlock slot is blocked by said padlock tab support portion and said padlock tab when said door is closed.

6. A storage locker according to claim 5 wherein said padlock tab support portion is joined to said base plate by a relatively yieldable section of material such that a force applied in the normal direction to said surface will cause the support portion to bend with respect to the base plate along said yieldable section before the base plate bends.

7. A storage locker according to claim 5 wherein said base plate is stiffened by a pair of stiffening legs wherein said legs are formed as extensions of said base plate extending from the base plate at right-angles.

8. A storage locker according to claim 5 wherein a security finger extends from the base plate towards said door, and wherein a portion of said security finger is notched and said notched portion is adapted to engage a portion of said door when said door is closed.

9. A storage locker according to claim 5 wherein said base plate is stiffened by a pair of stiffening legs wherein said legs are formed as extensions of said base plate extending from the base plate at right-angles and wherein a security finger extends from one of said legs toward said door, said finger having a notch formed therein for engaging a portion of said door when said door is closed.

10. A storage locker according to claim 7 wherein said latch side frame member includes a pair of openings formed therein and hook portions extending from each said stiffening leg engage one of said openings for securing said latch plate device to said frame.

11. A storage locker according to claim 5 wherein said door includes a lock device and said base plate includes a catch surface adapted to engage said lock device.

12. A storage locker comprising:

a frame structure having a hinge side frame member and a latch side frame member parallel to and spaced from said hinge side frame member;

a door pivotally mounted on said hinge side frame member, said door having a padlock slot formed therein;

a latch plate device connected to said latch side frame member for engaging said door when said door is closed, said latch plate device including:

a base plate having its surface parallel to the plane of said door;

a padlock tab support portion connected to said base plate;

a padlock tab fixed to said padlock support portion, said tab having a hole formed therein which is adapted to receive a padlock, said tab being adapted to extend through said padlock slot when said door is closed; and a security finger extending from said base plate towards said door, said finger having a notch formed therein for engaging a portion of said door when said door is closed.

13. A storage locker according to claim 12 wherein said security finger is planar and the plane of the security finger is substantially normal to the pivot axis of the door.

14. A storage locker according to claim 12 wherein said security finger is an extension of the base plate formed at a right angle to said surface of the base plate.

15. A storage locker according to claim 12 wherein a hook member extends from said base plate and engages one wall of said latch side frame member and said security finger is located in opposed alignment with said hook member.

16. A storage locker according to claim 14 wherein said padlock support portion is connected to said base plate by a relatively yieldable section such that a force applied in a direction normal to said surface of the base plate will cause the support portion to bend with respect to the base plate along said yieldable section before the base plate bends.

17. A storage locker according to claim 12 wherein said base plate is stiffened by a pair of stiffening legs wherein said legs are formed as extensions of said base plate extending from the base plate at right-angles.

18. A storage locker according to claim 12 wherein said base plate is stiffened by a pair of stiffening legs wherein said legs are formed as extensions of said base plate extending from the base plate at right-angles and wherein said security finger extends from one of said legs toward said door.

19. A storage locker according to claim 17 wherein said latch side frame member includes a pair of openings formed therein and hook portions extending from each said stiffening leg engage said openings for securing said latch plate device to said latch side frame member.

20. A storage locker according to claim 12 wherein said base plate includes a catch surface adapted to engage a lock mechanism.

* * * * *